United States Patent [19]

Inghirami

[11] Patent Number: 4,569,441

[45] Date of Patent: Feb. 11, 1986

[54] PACKAGING OF SHIRT-TYPE GARMENT

[76] Inventor: Fabio Inghirami, Viale Michelangelo, 16, San Sepolcro (Arezzo), Italy

[21] Appl. No.: 647,263

[22] Filed: Sep. 4, 1984

Related U.S. Application Data

[63] Continuation of Ser. No. 347,062, Feb. 8, 1982, abandoned.

[30] Foreign Application Priority Data

Feb. 11, 1981 [IT] Italy ..... 20752[U]

[51] Int. Cl.[4] ..... B65D 57/00

[52] U.S. Cl. ..... 206/292; 206/294; 223/71; 223/84

[58] Field of Search ..... 206/292, 294, 297, 298; 223/71, 84

[56] References Cited

U.S. PATENT DOCUMENTS

| | | | |
|---|---|---|---|
| 2,135,798 | 11/1938 | Cons | 223/71 |
| 2,563,043 | 8/1951 | Kahn | 223/71 |
| 2,615,601 | 10/1952 | Kahn | 223/71 |
| 3,098,590 | 7/1963 | Richardson | 223/71 |
| 3,989,172 | 11/1976 | Wiedemann et al. | 223/71 |

FOREIGN PATENT DOCUMENTS

| | | | |
|---|---|---|---|
| 1381438 | 1/1975 | United Kingdom | 206/292 |
| 2067969 | 8/1981 | United Kingdom | 206/292 |

*Primary Examiner*—William T. Dixson, Jr.
*Assistant Examiner*—Brenda J. Ehrhardt
*Attorney, Agent, or Firm*—Robert E. Burns; Emmanuel J. Lobato; Bruce L. Adams

[57] ABSTRACT

A shirt-type garment having a turn-down collar and a central row of buttons is folded longitudinally and transversely folded into approximately rectangular shape with a button at the back of the folded garment near a lower transverse fold. A cardboard panel having a width and length approximately equal to the width and length respectively of the folded garment, a tab at its upper end of a size and shape to fit under the garment collar, a central hole large enough to receive a button spaced from the lower end of the panel and a narrow slit extending down from the hole almost to the lower end of the panel, is placed on the back of the folded garment so that a button is received through the hole in the panel. The panel is then slid upwardly relative to the garment to bring the tab under the collar of the garment, the threads attaching the button being thereupon received in the slit of the panel, whereby the garment is held in position on the panel by the tab inserted under the fold-down collar and the threads of the button received in the slit in the panel, while having a "soft" appearance and feel.

10 Claims, 6 Drawing Figures

PACKAGING OF SHIRT-TYPE GARMENT

This is a continuation of application Ser. No. 347,062 filed Feb. 8, 1982 abandoned.

This invention relates to packaging a shirt or other similar garment with a stiffening element, particularly for preventing deformations thereof during transport.

A shirt stiffening system is known, which provides the use of a cardboard piece, on which the shirt is folded up; then the shirt is fastened by means of pins.

Thus the shirt is "stiffened" and accordingly is at particularly suitable conditions to face transport since the cardboard substantially prevents the shirt from being deformed and/or compressed.

Conversely, in other cases the shirt is folded up on paper and not on cardboard; in such a case, the shirt has a "soft" appearance, which is particularly accepted by some people, but there is the disadvantage in that the shirt, not being stiffened due to the absence of the cardboard, is subjected to deformation and compression during transport.

It is the primary object to provide means of very simple and particularly functional structure, allowing to obtain both of the benefits respectively including the possibility of preventing the shirt from being deformed during transport, and where desired, the possibility of providing for a "soft presentation or appearance" of the shirt.

According to the present invention, an element is provided for stiffening a shirt or other similar garment, which is essentially characterized by being formed of a shaped piece of sheet or plate material of some strength, such as cardboard or the like, comprising a shaped border or strip, projecting from one side of the element and designed to be slipped in under the shirt collar, at the rear of the collar, means being provided for coupling the element to a button of the shirt.

For better showing of these and further features of the element according to the present invention, as well as the advantages resulting therefrom, an exemplary embodiment of the element according to the invention will now be described with reference to the accompanying drawings, in which.

Figure 1:
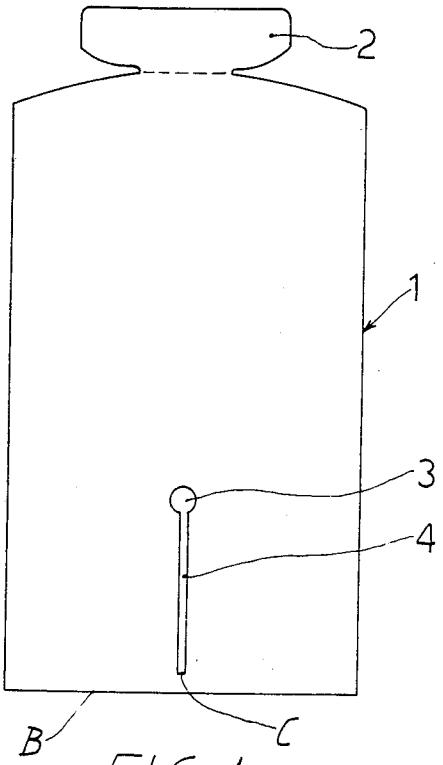
FIG. 1 is a plan view of the element.
Figure 2:
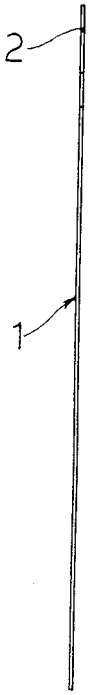
FIG. 2 is a side view of the element, or a view rotated through 90° relative to FIG. 1.
Figure 5:
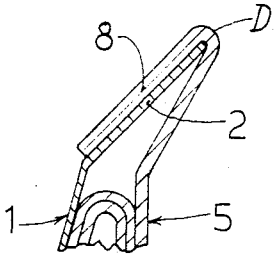
Figure 6:
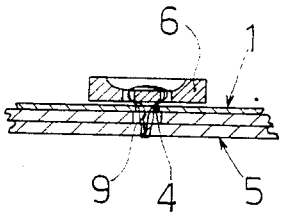
Figure 4:
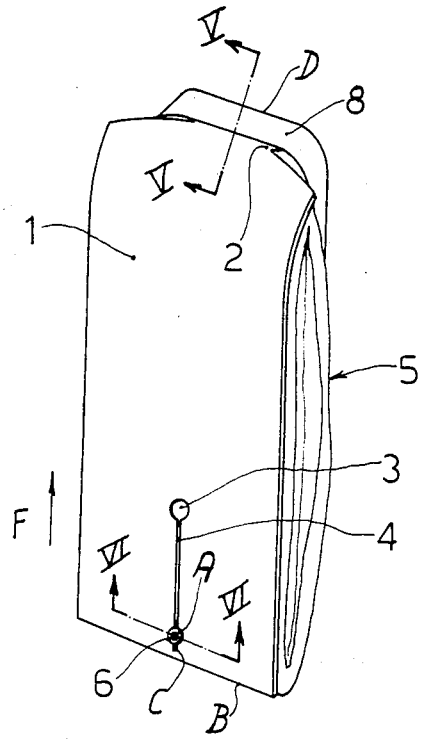
Figure 3:
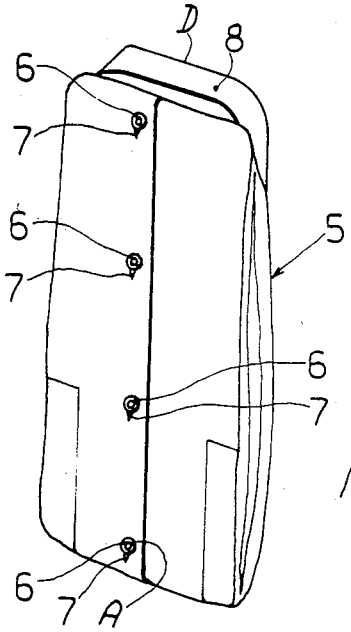

FIG. 3 schematically shows a conveniently folded up shirt, as seen from the rear;

FIG. 4 is a view showing the element of FIGS. 1 and 2, as applied to the shirt shown in FIG. 3;

FIG. 5 is an enlarged view of a sectional detail taken along line V—V of FIG. 4; and FIG. 6 is a further enlarged showing another sectional detail taken along line VI—VI of FIG. 4.

The element shown in the accompanying drawings is designated as a whole at 1.

The element 1 comprises a panel of shaped cardboard of sufficient strength. This panel 1 comprises a shaped strip or border 2, which as explained in the following, is designed to be slipped in under the shirt collar. As seen in FIG. 1 the strip or border 2 is in the form of a tab having wing portions extending laterally from a narrower central connecting portion.

The shirt is quite schematically shown and designated as a whole at 5, whereas at 6 the buttons are indicated, at 7 the corresponding buttonholes, and at 8 said collar, it being understood that the shirt may be of any type, that is for man, woman or child.

On the accompanying drawings, the shirt is shown in the form at which it is conveniently folded up for transport and sale in shops or other suitable sites; more particularly, the shirt is shown in the drawings as seen from the rear.

A hole 3 passes through said element, and is of a slightly larger diameter than that of the button 6. A cut or slit 4 branches off from said hole 3 and extends to the proximity of the lower edge B of the cardboard piece, at some distance from the edge. As illustrated in FIG. 1, the slit 4 is on the longitudinal center line of the panel 1 and extends upwardly from near the lower edge B a distance approximately equal to one third of the length of the panel excluding the tab 2.

Then, considering a shirt such as that shown on the drawings, as seen from the rear, the element 1 is applied to the shirt as follows.

The hole 3 is slipped on a button 6, particularly on the last button at the bottom, also designated at A. The element 1 is caused to slide towards the collar 8, that is in the direction of arrow F, while grazing or moving in contact with the shirt.

At this step, sliding is allowed owing to the cut or slit 4, as during the relative movement between the cardboard and shirt, the threads 9 joining the button 6 to the shirt fabric will slide in said cut or slit 4.

At some time, as said cardboard panel 1 moves in contact with the shirt, the strip or border 2 is slipped in under the shirt collar 8, such an insertion being manually aided by the operator. Now the cardboard panel 1 is stopped, or said sliding in the direction of arrow F is ceased.

The length of said cut or slit 4 is such that said sliding is allowed to the point where said strip or border 2 is seated under the collar 8, so as to encounter the upper edge D of the collar. More particularly, when sliding in the direction of arrow F the cardboard panel 1 is at some time stopped, the button 6, or the lowermost button also designated at A, has not reached the lower edge C of said cut or slit 4, but is at some distance therefrom.

When desiring the detach or separate the cardboard panel 1 from the shirt, for example for providing the "soft" presentation or appearance of the shirt, it would be only needed to slide the cardboard in the opposite direction to that of arrow F until said hole 3 is brought at the button 6, also designated at A, and then cause said button to come out of said hole.

What I claim is:

1. Packaging of a shirt-type garment comprising, a shirt-type garment having a fold-down collar and a plurality of buttons attached by thread to said garment, said garment being folded longitudinally and transversely into generally rectangular form in such manner that there is a button in a lower portion at the back of the folded garment, and a panel of cardboard having a width approximating the width of the folded garment and a length approximating the length of the folded garment, said panel having a central hole spaced from a lower end of said panel, said hole being large enough to receive a button of said garment, and a central narrow slit extending from said hole to a point near but spaced from the lower end of said panel, and said panel having at its upper end central projecting tab of a size and shape to be received under a rear portion of said collar of said garment, said panel being positioned outside of and behind said folded garment by said tab inserted under a rear portion of said collar and by a button of the garment inserted through said hole and then displaced to a position in which thread attaching said button to the garment extends through said slit at a point near but spaced from the lower end of said panel, whereby said folded garment is positioned on said panel by said tab extending under a rear portion of the collar and said button having thread extending through said slit.

2. Packaging according to claim 1, in which said tab has wing portions extending laterally from a narrower central portion connecting said tab with said panel.

3. Packaging according to claim 1, in which said tab is bent forwardly at an angle to said panel.

4. Packaging according to claim 1, in which said slit is straight.

5. Packaging according to claim 1, in which said hole is spaced from the lower end of the panel a distance equal to about one third of the length of the panel.

6. Packaging according to claim 1, in which the upper end of said panel is rounded.

7. A method of packaging a shirt-type garment having a fold-down collar, a plurality of buttons attached by thread along a first edge portion along a central opening and a like plurality of button holes along a second edge portion along an opposite side of said central opening, said method comprising:

folding said garment laterally and longitudinally into approximately rectangular form, with said buttons buttoned in said button holes and at least one button at the back of the folded garment and located near a lower transverse fold thereof, providing a panel of cardboard having a width approximately equal to the width of the folded garment and a length approximately equal to the length of the folded garment, said panel having a hole large enough to receive a button of said garment spaced from a lower end of said panel and a narrow slit extending from said hole to a point near but spaced from the lower end of said panel, said hole and slit being at least approximately on a longitudinal center line of said panel, and said panel having at its upper end a projecting tab of a size and shape to be received under a rear portion of the folded-down collar of said garment, and placing said panel on the back of the folded garment in position for a button on the back of said garment to pass through said hole in the panel, said button and hole being positioned such that the panel as thus placed projects downwardly beyond said lower transverse fold of the garment, and then sliding said panel upwardly relative to the folded garment to bring said tab under said folded-down collar, threads attaching said button to the garment being received in said slit.

8. A method of packaging a garment according to claim 7, further comprising bending said tab forwardly at an angle to said panel.

9. A method of packaging a garment according to claim 7, in which said tab has wing portions extending laterally from a narrower central portion connecting said tab with said panel.

10. A method of packaging a garment according to claim 7, in which the upper end of said panel is rounded.

* * * * *